United States Patent [19]

Reinehr et al.

[11] 3,975,337

[45] Aug. 17, 1976

[54] PROCESS FOR THE PRODUCTION OF ACRYLIC FIBERS PROCESSIBLE INTO YARNS WITH IMPROVED TEXTILE PROPERTIES AND LOW BOILING-INDUCED SHRINKAGE VALUES

[75] Inventors: Ulrich Reinehr; Alfred Nogaj; Wolfhard Schmidt, all of Dormagen, Germany

[73] Assignee: Bayer Aktiengesellschaft, Leverkusen, Germany

[22] Filed: Mar. 21, 1975

[21] Appl. No.: 560,938

Related U.S. Application Data

[63] Continuation of Ser. No. 361,556, May 18, 1973, abandoned.

[30] Foreign Application Priority Data

Apr. 20, 1972 Germany ..... 2219218

[52] U.S. Cl. ..... 526/341; 264/206; 264/210 F; 264/235

[51] Int. Cl.[2] ..... C08F 220/42; D01F 6/18

[58] Field of Search ..... 264/182, 206, 210 F, 264/235; 260/85.5 S

[56] References Cited

UNITED STATES PATENTS

| | | | |
|---|---|---|---|
| 3,091,507 | 5/1967 | Murdock et al. | 264/182 |
| 3,439,393 | 4/1969 | Murono | 264/182 |
| 3,485,913 | 12/1969 | Yamada et al. | 264/210 Z |
| 3,558,761 | 1/1971 | Tabare et al. | 264/182 |
| 3,624,196 | 11/1971 | Ball | 264/182 |
| 3,718,716 | 2/1973 | Job et al. | 264/182 |
| 3,864,447 | 2/1975 | Sekignchi et al. | 264/182 |

*Primary Examiner*—Jay H. Woo
*Attorney, Agent, or Firm*—Plumley and Tyner

[57] ABSTRACT

The invention relates to a process for the production of polyacrylonitrile tows containing from 7 – 15 % by weight, preferably from 10 – 12 % by weight, of comonomer components from which it is possible to produce yarns having low boiling-induced shrinkage values and yarns and dimensionally stable made-up articles with improved textile properties which comprises reducing the tow-shrinkage emanating from the spinning and stretching process by 80 – 95 % of the original tow shrinkage by heat-fixing and eliminating subsequently the residual shrinkage by fixing with saturated steam.

2 Claims, No Drawings

PROCESS FOR THE PRODUCTION OF ACRYLIC FIBERS PROCESSIBLE INTO YARNS WITH IMPROVED TEXTILE PROPERTIES AND LOW BOILING-INDUCED SHRINKAGE VALUES

This is a continuation of application Ser. No. 361,556, filed May 18, 1973, now abandoned.

This invention relates to a process for the production of polyacrylonitrile spun-strand tows containing from 7 to 15% by weight of copolymerized comonomer components which, after processing into yarns, show low boiling-induced shrinkage and improved textile properties.

French Pat. No. 1,557,242 discloses that low-shrinkage acrylic fibres can be produced by removing solvent residues from the moist acrylic tow, followed by drying of the crimped or uncrimped tow with a moisture content of from 80 to 200%, based on the dry fibre mass, continuously in the absence of tension at temperatures in the range of from 100°to 160°C.

Other processes are based on the effect of superheated steam, hot air or inert gases on acrylic tows which are either passed through heated zones or subjected to particularly mild fixing stages. According to British patent specification No. 1,161,939, the tow is for example washed and stretched, subjected in the absence of tension to a wet-heat fixing operation at a temperature of 60°to 100°C and then dried.

One feature common to the above mentioned processes for the production of acrylic fibres having low shrinkage values and improved fibre properties is that they relate to copolymers of acrylonitrile which generally have comonomer contents of only up to 7% by weight, based on acrylonitrile, which means that they are unsuitable for example for the production by acrylic fibres with an affinity for acid dyes. In practice, acrylic fibres of this kind generally contain more then 10% by weight of comonomer constituents.

It is also known that fibres produced from copolymers of acrylonitrile with neutral, acid or basic commonomers which have a comonomer content exceeding 7 to 8% by weight, show increased shrinkage behaviour. As is known from the literature, this shrinkage behaviour is affected very considerably by the comonomer content of the acrylic fibres. An increasing content of comonomer constituents results in increased shrinkage values (W. Lauterberg et al., DEUTSCHE TEXTIL TECHNIK 18 (1968) 10, 657). Yarns and textile articles produced from acrylic fibres such as these generally have boiling-induced yarn shrinkage values in the range of from 6 to 10%, despite the fact that the fibre material has been fully fixed beforehand and, hence, shows no more fibre shrinkage. Accordingly, the use of fibre material of this kind in practice is attended by serious disadvantages. For example, yarns of acrylic fibres modified in this way are unsuitable for cheese dyeing. After shrinkage effects occur in the case of piece-dyed and hank -dyed material. At the same time, this results in deterioration both of feel and of dimensional stability, as reflected for example in bagginess in the case of sheet-formed textile products.

The object of the present invention is to obviate the disadvantages referred to above. According to the invention, this object is achieved by virtue of the fact that the increased tow shrinkage, emanating from the spinning and stretching process, of about 30% and more of, in particular, acrylic fibres modified with 7 to 10% by weight of comonomer components is removed by combining a heat fixing process with a steam-fixing process.

Accordingly, the invention provides a process for the production of polyacrylonitrile tows containing from 7 to 15% by weight, preferably from 10 to 12% by weight, of comonomer components from which it is possible to produce yarns having low boiling-induced shrinkage values and yarns and dimensionally stable made-up articles with improved textile properties, which comprises reducing the tow shrinkage emanating from the spinning and stretching process by 80 to 95% of the original tow shrinkage by heat-fixing and eliminating subsequently the residual shrinkage by fixing with saturated steam. Optionally the heat-fixing is a multiple-stage heat-fixing process and optionally the fixing with saturated steam is effected after the tow has been cut into staple fibres.

The temperatures required for heat fixing can be varied within the wide limits of 100°to 180°C, depending upon the rate of travel of the tow. The temperature at the dryer inlet is within the range of from 100°to 180°C and, at the dryer outlet, between 40°and 80°C. The temperature gradient is linear. The heat shrinkage treatment of the tow is carried out continuously, preferably in stages under light tension, in such a way that the tow, which contracts during shrinkage, passes through the drying installation (perforated drums or sheet-metal screens) in an orderly form with a substantially smooth surface. The rate of travel of the tow amounts to from 20 to 80 m/minute whilst its residence time in the drying installation amounts to from 60 to 180 seconds, preferably from 60 to 120 seconds.

The residual boiling-induced shrinkage of the tow after heat-fixing should not exceed 5 to 20%, preferably 10 to 15%, of the tow shrinkage originally present after washing and stretching.

Removal of the residual shrinkage after heat-fixing is carried out by fixing in a saturated steam atmosphere. Although it is known that fibre material can be fully shrunk under saturated steam conditions, it is only possible to obtain low boiling-induced shrinkage values in fibres with a comonomer content of from 7 to 15% by carrying out fixing in a saturated steam atmosphere in combination with the heat shrinkage treatment. If this requirement is not satisfied and if, for example, only superheated dry steam or wet-heat is present, the boiling-induced shrinkage values rapidly increase back to more than 6%. Acrylic fibres aftertreated by the process according to the invention, in the form of yarns and knitted articles show outstanding dimensional stability and feel with no after-shrinkage effects, for example during dyeing or steaming, in addition to low boiling-induced yarn shrinkage values.

Another advantage of the process according to the invention is that it is even possible to produce yarns having boiling-induced shrinkage values of less than 5% from fine-denier fibres. The boiling-induced yarn shrinkage of acrylic fibres containing 7 to 15% by weight of comonomer constituents is also known to be governed to a considerable extent by denier. Yarns of fine-denier fibres, for example fibres having a denier of 1.6 dtex, generally show a boiling-induced yarn shrinkage some 50 to 100% higher than that of fibre yarns having a denier of 3.3 or 6.7 dtex. It has now been found that yarns with boiling-induced shrinkage values of less than 5% can also be produced from fine-denier fibres that have been treated by the process according to the invention.

Generally, it is possible by the process according to the invention to produce yarns based on polyacrylonitrile fibres with boiling-induced yarn shrinkage values of less than 5%, preferably in the range of from 1 to 4%. Accordingly, the invention also relates to yarns of this kind.

To obtain high affinity for dyes, unsaturated acid or basic comonomers are copolymersied with acrylonitrile. Whereas adeuqate affinity for basic dyes is generally obtained by copolymerising acrylonitrile with 0.5 to 1% by weight of unsaturated sulphonic acids, such as vinyl-, allyl-, methallyl- or styrene-sulphonic acid, an equally high affinity for acid dyes can generally only be obtained with a 3 to 10 times higher proportion by weight of basic comonomers. Examples of suitable basic comonomers include aliphatic unsaturated amines such as acrylic acid amide, dimethylamino ethyl methacrylate or vinyl-substituted tertiary N-heterocyclic compounds, such as vinyl imidazoles and vinyl pyridines, for example 2- and 4-vinyl pyridine or 2-methyl-5-vinyl pyridine.

Since the copolymerization of acrylonitrile with unsaturated amines is generally carried out in the presence of other neutral comonomers such as methyl acrylate, methyl methacrylate, vinylacetate or isolutene diacetate, in order to improve the fibre properties, ternary copolymers with comonomer contents generally in excess of 7 to 8% by weight are preferentially obtained in the case of acid-dyeable acrylic fibres. Accordingly, the aftertreatment process according to the invention for acrylic fibres having increased comonomer contents is particularly suitable in the case of acid-dyeable acrylic fibres for obtaining the required low yarn shrinkages, feel and dimensional stability.

In order to obtain differential dyeing effects, acrylic fibres having a normal affinity for acid or basic dyes are combined with acrylic fibres having an increased content of acid or basic comonomers so as to obtain differential dyeing effects. Since, in addition to the increased acid or basic comonomer content, acrylic fibres of this kind generally contain neutral comonomers as well, such as methyl acrylate or vinyl acetate for example, these ternary copolymers can also be used for the production of tows by the process according to the invention.

The acrylonitrile polymers treated in accordance with the invention are produced by conventional polymerization processes, subsequently spun and further processed. Acrylic fibres produced by dry spinning are treated for example as follows in tow-production lines: the tow is wet-stretched at an elevated temperature in the range of from 80°C up to the boiling temperature, washed free of the solvent, brightened and then dried at a temperature above 100°C, generally under tension or slight shrinkage. The tow is then crimped, cut up and shrinkage eliminated by hot steaming.

Although, in cases where acrylic fibres having a comonomer content of more than 7% by weight, preferably in the range of from 10 to 15% by weight, are aftertreated in this way, it is not possible to measure any more fibre shrinkage, the boiling-induced yarn shrinkage amounts to more than 6%. If the fixing conditions are varied in such a way that the tow is allowed to undergo partial shrinkage for example during the drying process, for example by eliminating between 50 and 70% of the original tow shrinkage and fixing the residual boiling-induced shrinkage by steaming, the fibre shrinkage is again negligible whereas the boiling-induced yarn shrinkage values again amount to more than 6%.

If, in addition, fine-denier fibres, for example fibres of denier 1.6 dtex, are treated in this way, the boiling-induced yarn shrinkage actually amounts to as high as 10 to 11%, as shown in Comparison Example 4.

EXAMPLES

EXAMPLE 1

An acrylonitrile polymer comprising 88.7% of acrylonitrile, 5.8% of methyl acrylate and 5.5% of 2-methyl-5-vinyl pyridine was dry spun by conventional processes. The spun strands were combined into a tow with an overall denier of 1,620,000 dtex, stretched in boiling water to 4.3 times its original length, washed out with water and brightened. The shrinkage of the tow amounted to 30%. The tow was then subjected to dry shrinkage treatment in a conventional drying installation comprising 14 perforated cylinders. The degree of shrinkage could be adjusted as required on cylinders 1 to 5. The treatment was carried out in stages to 18% and 7%, so that the tow left the drying installation having a residual boiling-induced shrinkage of approximately 5%. The rate of travel of the tow amounted to approximately 50 m/minute, and its residence time in the drying installation to about 70 seconds. The temperature at the inlet end of the drying installation was in the range of from 150° to 160°C. and, at the outlet end, to from 60° to 70°C. The temperature gradient was linear. The tow was then erimped, cut, continuously sprayed with saturated steam at 110° to 115°C and then dried at temperatures of from 130° to 140°C, cooled by sucking air through it and then compressed into bales. The combined residence times in the steaming and drying zones were about 150 seconds. The quantity of steam sprayed onto the tow amounted to from 350 to 400 kg of saturated steam per hour. Yarns produced from this tow with a denier of 6.7 dtex had a boiling-induced yarn shrinkage of 2.9%. Tensile strength (g) = 21.5; breaking elongation = 58%.

Boiling-induced shrinkage values of other yarns produced from similarly treated fibres of different denier are shown in the following Table.

| Spun strand tow overall denier | Stretching | Individual fibre final denier | Boiling-induced yarn shrinkage value |
|---|---|---|---|
| 1,210,000 dtex | 1 : 3.6 | 1.6 dtex | 4.4 % |
| 1,510,000 dtex | 1 : 4.0 | 3.4 dtex | 2.7 % |
| 1,965,000 dtex | 1 : 4.3 | 5.4 dtex | 2.6 % |
| 1,620,000 dtex | 1 : 4.3 | 6.7 dtex | 2.9 % |
| 1,480,000 dtex | 1 : 3.6 | 11.0 dtex | 2.0 % |
| 568,000 dtex | 1 : 2.4 | 17.0 dtex | 2.4 % |

EXAMPLE 2

An acrylonitrile polymer having the same composition as that used in Example 1 was dry spun and the spun strands combined into a tow with an overall denier of 840,000 dtex. The tow was stretched in boiling water to 4.5 times its original length, washed with water and brightened. The shrinkage of the tow amounted to 33.0%. During the subsequent heat shrinkage treatment, the temperature at the inlet end of the drying installation was 130°C and, at the outlet end, from 40° to 50°C. The rate of travel of the tow was 40 m/minute and its residence time in the drying installation approximately 60 seconds. The multiple-stage shrinkage and saturated-steam fixing treatment were carried out in the same way as described in Example 1. Fibre yarns produced from this tow with a denier of 3.3 dtex had a boiling-induced yarn shrinkage of 3.4%. Tensile strength (g) = 8.2; breaking elongation = 51%.

EXAMPLE 3

An acrylonitrile polymer comprising 89.6% of acrylonitrile, 5.0% of 1,3-diacetoxy-2-methylene propane and 5.4% of 2-methyl-5-vinyl pyridine was dry spun and the spun strands were combined into a tow (overall denier = 885,000 dtex). The tow was stretched in boiling water in a ratio of 1 : 3.6, washed and brightened. The shrinkage of the fibre tow after spinning and stretching amounted to 26%. Shrinkage in two stages to 12% and 10% left a residual shrinkage of 4% which was eliminated by fixing with saturated steam. Fibre yarns produced from this tow with a denier of 3.3 dtex had a boiling-induced yarn shrinkage of 3.4%. Tensile strength (g) = 8.5; breaking elongation = 50.0%.

EXAMPLE 4

An acrylonitrile polymer of 90.5% comprising acrylonitrile, 5.0% of methyl acrylate and 4.5% of dimethylamino ethyl methacrylate was dry spun by onventional processes. The spun strands with an overall denier of 1,040,000 dtex were combined and stretched in a ratio of 1 : 4.1 in boiling water, washed and brightened. The shrinkage of the tow after stretching amounted to 26%. More than 80% of the shrinkage originally present was removed by heat-fixing in two stages of 11% each. The temperatures were 125° to 130°C at the inlet end of the drying installation and about 50°C at the outlet end. The rate of travel of the tow was 35 m/minute and its residence time in the drying zone approximately 60 seconds. The residual boiling-induced shrinkage amounting to approximately 4% was removed by fixing with saturated steam. The boiling-induced yarn shrinkage of yarns produced from 6.7 dtex fibres amounted to 3.3%. Tensile strength (g) = 19.9; breaking elongation = 49.0%.

EXAMPLE 5

An acrylonitrile polymer comprising 91.3% of acrylonitrile; 5.0% of methyl acrylate and 3.7% of diisopropylamino ethyl methacrylate was dry spun. The spun strands were combined into a tow and stretched in boiling water to 3.6 times their original length, washed and brightened. The shrinkage of the tow after stretching amounted to 25%. During the subsequent heat shrinkage treatment, so much shrinkage was eliminated that only about 10% of the tow shrinkage originally present were left. Shrinkage in two stages of 11% each left a residual boiling-induced shrinkage of 3% which was removed by fixing with saturated steam. The boiling-induced yarn shrinkage of 3.3 dtex fibre yarns amounted to 3.0%. Tensile strength (g) = 9.1; breaking elongation = 49.0%.

EXAMPLE 6

An acrylonitrile polymer comprising 93.0% of acrylonitrile and 7.0% of methallyl sulphonic acid was dry spun, the spun strands were combined into a tow and then stretched in boiling water to 3.6 times their original length. The tow was then washed and brightened. The shrinkage of the tow after stretching amounted to 24 to 25%. During heat-fixing, at least another 80% of the original shrinkage was removed by shrinking in two stages of 10% each. The residual shrinkage left, amounting to approximately 4.5%, was removed by fixing with saturated steam. Fibre yarns of this acrylic material (final individual-fibre denier 3.3 dtex) had a boiling-induced yarn shrinkage of 2.4%. Tensile strength (g) = 9.3; breaking elongation = 53.0%.

EXAMPLE 7

An acrylonitrile polymer comprising 91.1% of acrylonitrile, 5.5% of methyl acrylate and 3.4% of methallyl sulphonic acid was dry spun, the spun strands were combined into a tow and then stretched in boiling water to 3.6 times their original length. The tow was then washed and brightened. The tow shrinkage after stretching was 23 and 24%. During heat-fixing, at least another 80% of the original shrinkage was removed by shrinking in two stages to 15% and 5%. The residual shrinkage of 3 to 4% was eliminated by fixing with saturated steam. Fibre yarns produced from this acrylic material (final individual-fibre denier 3.3 dtex) had a boiling-induced yarn shrinkage of 4.1%. Tensile strength (g) = 8.2; breaking elongation = 39%.

EXAMPLE 8 (Comparison)

An acrylonitrile polymer comprising 88.7% of acrylonitrile, 5.8% of methyl acrylate and 5.5% of 2-methyl-5-vinyl pyridine was dry spun by conventional methods. The spun strands were combined into a tow with an overall denier of 1,040,000 dtex, stretched 1 : 4.1 in boiling water, washed out with water and brightened. The shrinkage of the tow amounted to 30%. The tow is then dried under tension in a conventional drying installation comprising perforated cylinders. The rate of travel of the tow was 60 m/minute and its residence time in the drying installation approximately 60 seconds. The temperature at the inlet end of the drying installation was in the range of from 140° to 150°C and, at the outlet end, from 60° to 70°C. The temperature gradient was linear. The shrinkage of the tow still amounted to between 10 and 20% after passing through the drying installation. The tow was crimped, cut and then sprayed continuously with saturated steam at 110° to 115°C, fixed and dried at temperatures of from 130° to 140°C. The total residence time for the steaming and drying process was about 90 seconds and the quantity of steam sprayed on approximately 400 kg/hour. No appreciable fibre shrinkage was measured thereafter. Yarns produced from the fibres having an individual final denier of 6.7 dtex had a boiling-induced yarn shrinkage of 7.3%. Tensile strength (g) = 17.8; breaking elongation = 51%.

If the test is varied, for example by increasing the residence time of the tow during fixing with saturated steam from about 90 to 150 seconds, the boiling-induced yarn shrinkage values remain unaffected.

EXAMPLE 9 (Comparison)

An acrylonitrile polymer having the same composition as in Comparison Example 8 was spun in the same way. The tow with an overall denier of 1,130,000 dtex was stretched 1 : 3.9 washed and brightened. The shrinkage of the tow again amounted to 30%. The tow was then introduced into a conventional drying installation with perforated cylinders and 50% of the tow shrinkage originally present were removed. Accordingly, the tow had a residual shrinkage of 14 to 15%. The rate of travel of the tow its residence time in the drying installation and the temperatures in the drying installation correspond to the details of Comparison Example 8. The tow was crimped, cut, fixed with saturated steam and dried. Residence time approximately 100 to 110 seconds, quantity of steam sprayed on approximately 350 kg per hour. The boiling-induced yarn shrinkage of fibre yarns of this material (final individual-fibre denier 3.3 dtex) amounted to 8.3%. Tensile strength (g) = 7.7; breaking elongation = 45%.

The boiling-induced yarn shrinkage values of other yarns produced from similarly treated fibres of different denier are shown in the following Table:

| Spun strand tow overall denier | Stretching | Individual fibre final denier | Boiling-induced yarn shrinkage |
|---|---|---|---|
| 1,480,000 dtex | 1 : 3.6 | 1.6 dtex | 11.0 % |
| 1,030,000 dtex | 1 : 3.9 | 3.3 dtex | 8.3 % |
| 1,130,000 dtex | 1 : 3.9 | 6.7 dtex | 6.7 % |

EXAMPLE 10 (Comparison)

An acrylonitrile polymer comprising 90.5% of acrylonitrile, 5% of methyl acrylate and 4.5% of dimethylamino ethyl methacrylate was dry spun by conventional processes. The tow with an overall denier of dtex 885,000 was stretched in boiling water to 4.1 times its original length, washed with water and brightened. The tow shrinkage amounted to approximately 26%. The tow was subjected to dry shrinkage treatment in a drying installation comprising perforated cylinders.

Shrinkage was carried out in two stages of 9% each so that the tow still had a residual shrinkage of about 8%. The rate of travel of the tow was 50 m/minute and its residence time in the drying installation approximately 70 seconds. The temperature at the inlet end of the drying installation was in the range of from 150°C and, at the outlet end, from 60° to 70°C. The tow was crimped, cut, fixed with saturated steam at 110° to 115°C and then dried at temperatures of around 130°C. Total residence time was approximately 150 seconds for a spraying-steam input of 350 kg per hour. The tow was cooled with air and compressed into bales. The yarn shrinkage of fibre yarns produced from this material (final individual-fibre denier 3.3 dtex) amounted to 6.7%. Tensile strength (g) 32 9.7; breaking alongation = 52%.

EXAMPLE 11 (comparison)

An acrylonitrile polymer comprising 95% of acrylonitrile and 7% of methallyl sulphonic acid was dry spun, the spun strands with an overall denier of 790,000 dtex were combined into a tow stretched 1 : 3.6 in boiling water, washed with water and brightened. The shrinkage of the tow amounted to 25%. 15% of the shrinkage were eliminated during heat-fixing. The rate of travel of the tow was 25 m/minute and its residence time in the drying installation approximately 120 seconds. The temperature at the inlet end of the drying installation was from 130° to 140°C and, at the outlet end, from 50° and 60°C. The residual shrinkage of 10% was removed by saturated steam after the tow had been crimped and cut. Fibre yarns produced from this material (final individual-fibre denier 3.3 dtex) had a boiling-induced yarn shrinkage of 5.6% although once again there was no measurable fibre shrinkage. Tensile strength (g) = 7.4; breaking elongation = 45%.

EXAMPLE 12 (Comparison)

An acrylonitrile polymer comprising 88.7% of acrylonitrile 5.8% of methyl acrylate and 5.5% of 2-methyl-5-vinyl pyridine was dry spun by standard methods known in the art. The spun strands were combined into a tow with an overall denier of 1,050,000 dtex, stretched 1 : 4.6 in boiling water, washed with water and brightened. The shrinkage of the tow amounted to 30%. The tow was then introduced into a conventional drying installation comprising perforated cylinders and shrunk in two stages to 18% and 12% so that the tow left the drying installation without any residual shrinkage. The rate of travel of the tow was 50 m/minute and its residence time in the drying installation approximately 70 seconds. The temperature at the inlet end of the drying installation was from 160° and 170°C and, at the outlet end, from 60° and 70°C. The tow was then crimped, cut and the fibre assemblage formed cooled by drawing air through it and compressed into bales without the otherwise usual steam fixing treatment. Fibre yarns produced from this material (final individual-fibre denier 3.3 dtex) had a boiling-induced yarn shrinkage of 7.2%, although once again there was no measurable fibre shrinkage. Tensile strength (g) = 8.1; breaking elongation = 48%.

EXAMPLE 13 (Comparison)

An acrylonitrile polymer of 91.1% comprising acrylonitrile, 5.5% of methyl acrylate and 3.4% of methallyl sulphonic acid was dry spun. Aftertreatment of the tow was carried out in the same way as described in Comparison Example 8 (drying under tension). The shrinkage of the tow amounted to from 16 to 17% after passing through the drying installation. No more fibre shrinkage was measured after mixing with saturated steam. Acrylic yarns produced from this fibre material (individual denier 3.3 dtex) had a boiling-induced yarn shrinkage of 6.8%. Tensile strength (g) = 7.3; breaking elongation = 33%.

EXAMPLE 14

In order to demonstrate the improved dimensional stability of textile articles produced from fibre yarns according to Example 1, premarked knitted fabrics were dyed with acid dyes in an HT-paddle at 104°C, subsequently brightened, spun and then dried in a tumbler at a maximum temperature of 80°C. The dimensional changes brought about by dyeing were then determined. Knitted fabrics produced from fibre material according to Comparison Example 9 were used for comparison. The dimensional changes are shown in the following Table:

| Fibre denier (dtex) | Yarn count (Nm) | Boiling-induced yarn shrinkage | After-treatment process | Dimensional change length | Dimensional change width |
|---|---|---|---|---|---|
| 3.3 | 36/1 | 8.3 % | Comparison Example 9 | −24% | + 50% |
| 3.3 | 36/1 | 2.7 % | Example 1 | −12% | + 25% |

As can be seen from the Table, knitted articles of fibre yarn produced by the process according to the invention show much greater dimensional stability. In addition, they show improved feel and non-crease properties, coupled with a smooth, fold-free surface. Other fibre properties, such as tensile strength and breaking elongation, are also positively affected, as shown by a comparison between Example 8 (Comparison) and Example 1 according to the invention.

EXAMPLE 15

An acrylonitrile polymer comprising 91% of acrylonitrile, 5.2% of methyl acrylate, 2.8% of methallyl sulphonic acid and 1% of methacroylamino benzene benzene disulphonimide was dry spun, the spun strands were combined into a tow and stretched to 3.6 times their original length in boiling water. The tow was then washed and brightened. The tow shrinkage after stretching amounted to 23 to 24%. At least 80% of the original shrinkage was removed during heat-fixing by shrinking in tow stages to 15% and 5%. The residual shrinkage of 3 to 4% was eliminated by fixing with saturated steam. Fibre yarns produced from this acrylic material (end individual fibre denier 3.3 dtex) had boiling-induced yarn shrinkage of 4.5%. Tensile strength (g) = 8.2; breaking elongation = 42%.

EXAMPLE 16 (Comparison)

An acrylonitrile polymer with the same composition as that used in Example 15 was dry spun by conventional methods. The spun strands were combined into a tow having an overall denier of 955,000 dtex, stretched 1 : 3.6 in boiling water, washed with water and brightened. The shrinkage of the stretched tow again amounted to 23 to 24%. The tow was then dried under tension in a conventional drying installation comprising perforated cylinders. The rate of level of the tow was 30 m/minute and its residence time in the drying installation approximately 60 seconds. The temperature at the inlet end of the drying installation was from 160° to 170°C and, at its outlet end, from 70° to 80°C. The temperature gradient was linear. The shrinkage of the tow still amounted to 16 to 17% after passing through the drying installation. The tow was crimped, cut, fixed with saturated steam and dried. Residence time approximately 100 to 110 seconds, input of spraying steam approximately 350 kg per hour. The boiling-induced yarn shrinkage of fibre yarns of this material (final individual-fibre denier 3.3 dtex) amounts to 6.7%. Tensile strength (g) = 7.8; breaking elongation = 37%.

What we claim is:

1. A process for the production of a polyacrylonitrile spun strand tow containing from 7 to 15% by weight of a copolymerized comonomer, which comprises reducing by 80 to 95% the original tow shrinkage emanating from the dry spinning and stretching process by:

1. stretching said dry spun tow in hot water at 80° to 100°C;
2. dry heat fixing said tow for 60 to 100 seconds at a temperature of 100° to 180°C;
3. eliminating subsequently the residual shrinkage to less than 5% by passage of saturated steam thereover at 110°–115°C and;
4. drying said tow at about 130°–140°C.

2. The product of the process of claim 1.

* * * * *